US005173217A

United States Patent [19]

Buckle

[11] Patent Number: 5,173,217

[45] Date of Patent: Dec. 22, 1992

[54] METHOD AND APPARATUS FOR CONTAINING WASTES

[75] Inventor: John Buckle, Highlands Ranch, Colo.

[73] Assignee: British Nuclear Fuels plc, Warrington, United Kingdom

[21] Appl. No.: 804,035

[22] Filed: Dec. 9, 1991

[30] Foreign Application Priority Data

Dec. 15, 1990 [GB] United Kingdom ..... 9027236

[51] Int. Cl.[5] ..... G21F 9/16

[52] U.S. Cl. ..... 252/628; 252/633; 220/277; 206/571; 206/366

[58] Field of Search ..... 252/628, 633; 220/277; 206/571, 366; 423/Dig. 20

[56] References Cited

U.S. PATENT DOCUMENTS

| | | | |
|---|---|---|---|
| 2,019,733 | 1/1933 | Kollason | 220/277 |
| 3,440,797 | 4/1969 | Spielmann | 220/277 |
| 4,690,180 | 9/1987 | Gold | 141/51 |

*Primary Examiner*—Donald P. Walsh
*Assistant Examiner*—Ngoclan T. Mai
*Attorney, Agent, or Firm*—William R. Hinds

[57] ABSTRACT

Wastes are placed in a container, and the container is closed by a lid having a port sealed by a disc. A cutting tool having a hollow drive stem pierces the disc. A grout slurry is fed through the stem so as to discharge into the container and embed the wastes in the grout when set. The wastes may be contained in a crate in the container, and may also take the form of a glove box which itself contains waste objects.

19 Claims, 5 Drawing Sheets

METHOD AND APPARATUS FOR CONTAINING WASTES

This invention relates to a method and an apparatus for containing wastes, and more particularly to radioactive wastes.

According to one aspect of the present invention, there is provided a method of containing wastes comprising placing the wastes in a container and introducting a grout slurry into the container to fill voids in the container, thereby to embed the wastes into a solidified mass upon setting of the grout slurry, the method including closing the container with the wastes therein, piercing the container with a hollow cutting means, introducing the grout slurry into the container through the cutting means, and retaining the cutting means in the container.

According to another aspect, the invention provides an apparatus for containing wastes, the apparatus comprising, a closable container for enclosing the wastes, hollow cutting means for piercing the container and for introducing a grout slurry therethrough into the container, the cutting means being detachable so as to be retained in the container after the grout slurry has been introduced therein.

BRIEF DESCRIPTION OF THE DRAWINGS

The invention will now be further described, by way of example only with reference to the accompanying drawings, in which:

With reference to FIG. 1 a containment for the disposal of radioactive waste material comprises an outer container 1, which can be of carbon or stainless steel, housing a crate 2, which can be wood, and which in turn, houses a used glove box 3. The glove box 3 can contain a variety of contaminated radioactive products such as gloves, tissues, tools in addition to fixed or loose in-box process equipment.

Figure 1:
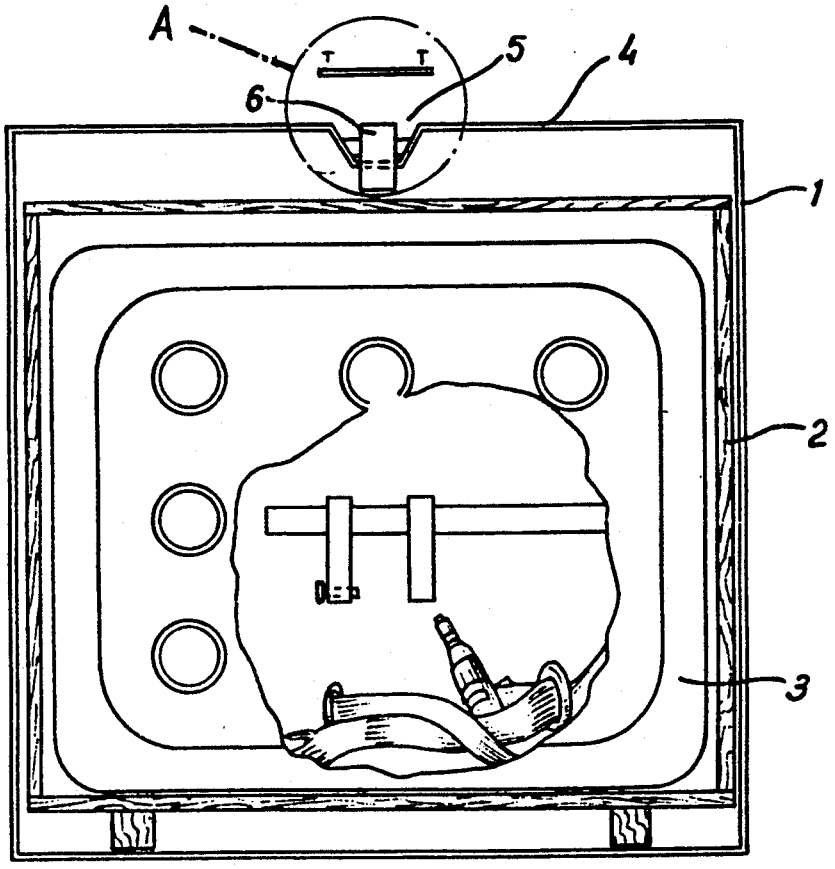
FIG. 1 shows a general arrangement of a containment for crated waste radioactive products.
Figure 2:
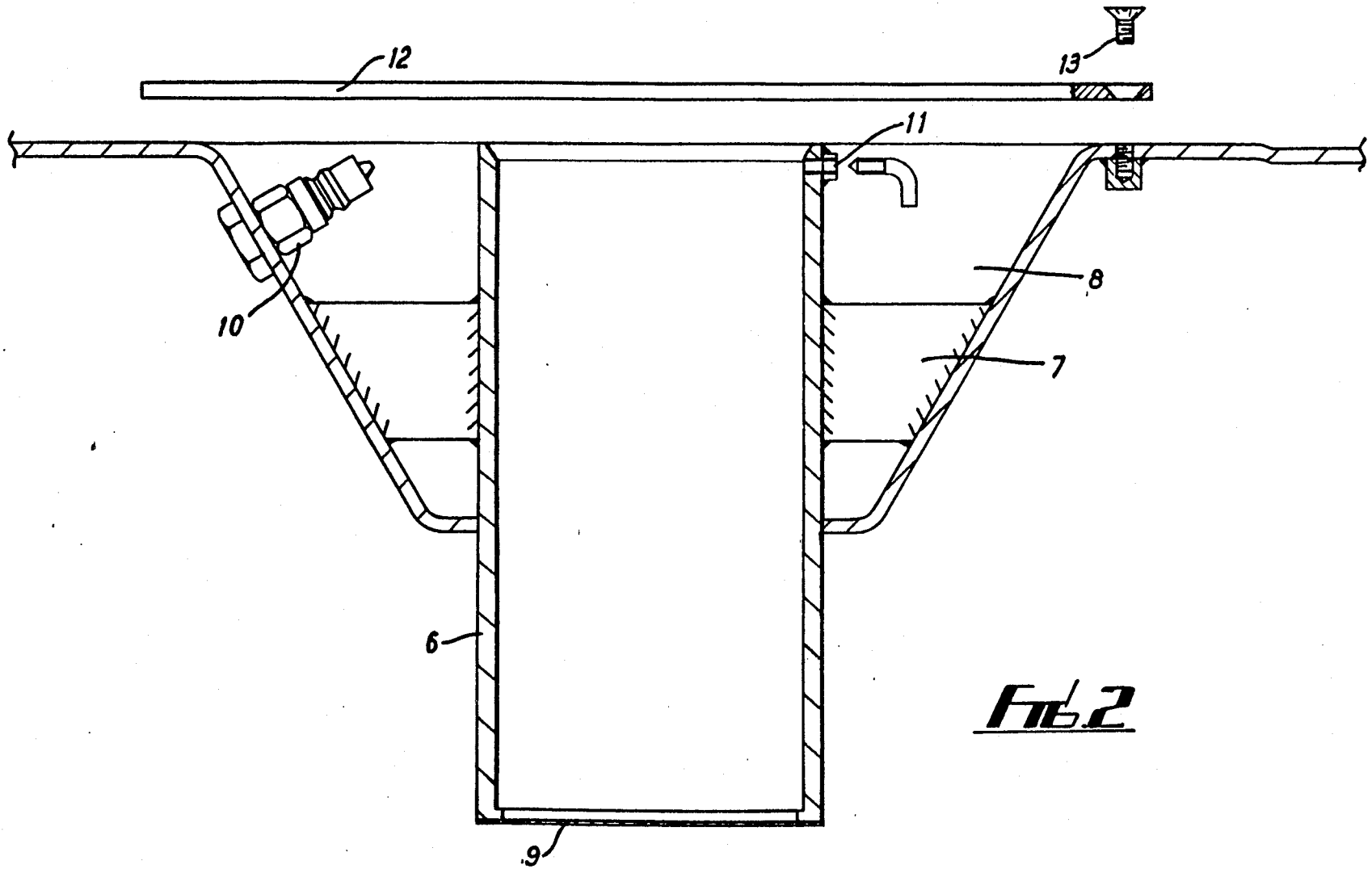
FIG. 2 is a detail of the part of the containment with the circle A of FIG. 1.

The container 1 has a lid 4 provided with an entry port 5 which is shown in greater detail in FIG. 2. The port 5 comprises a support tube 6 which extends through the lid 4 and is secured by webs 7 in a well 8 in the lid 4. The end of the tube 6 within the container 1 is closed by a bursting disc 9, conveniently of aluminum, which is bonded to the end of the tube 6. A vent coupling 10 is mounted in the lid 4 at the well 8. A locking screw 11 is provided at or adjacent the end of the tube 6 outside the container 1. Finally, a cover plate 12 for the well 8 is provided and a sealing ring or compound is introduced between the plate 12 and the lid 4 before the plate 12 is clamped in position by means of screws 13.

Figure 3:
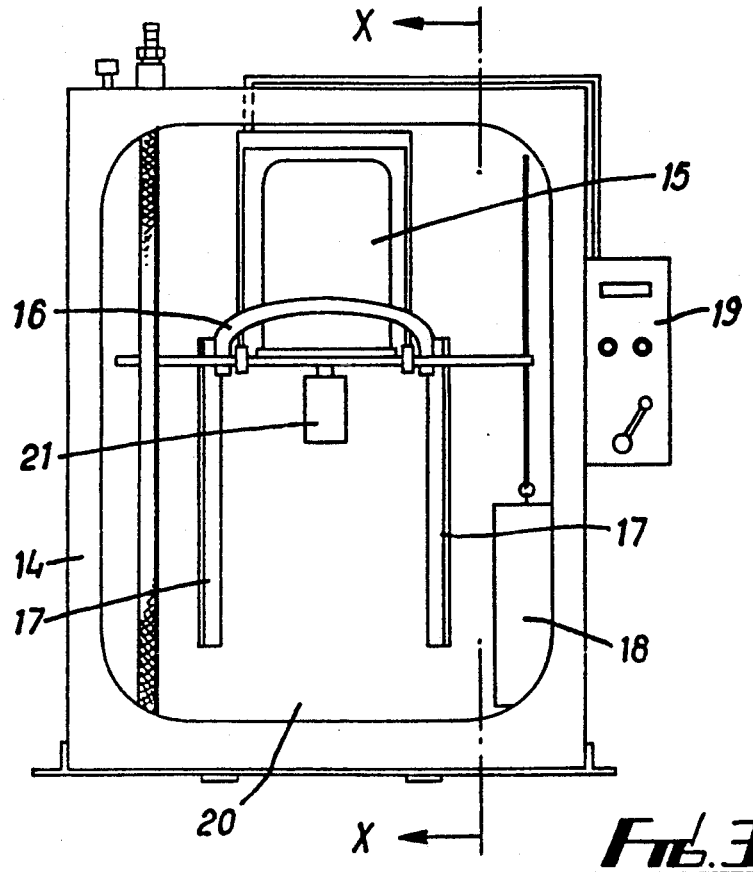
FIG. 3 shows a front elevation of a cabinet containing means for cutting and introducing a grout slurry.
Figure 3A:
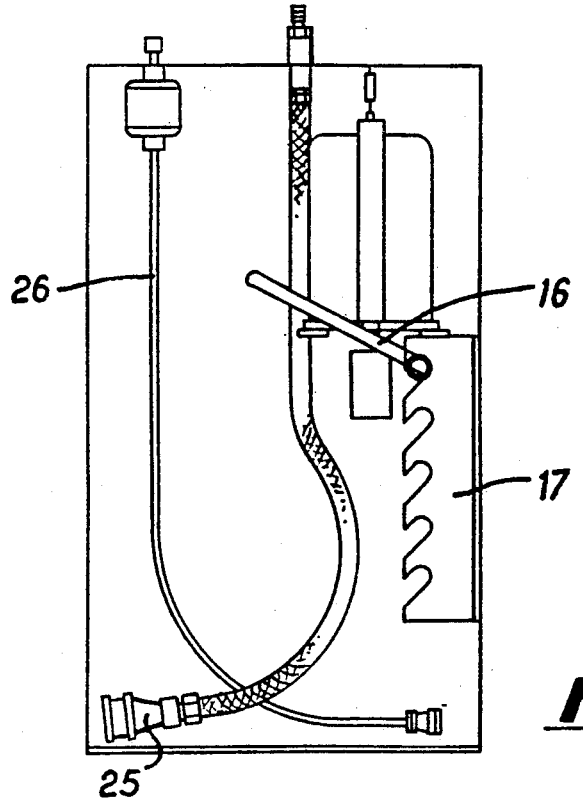
FIG. 3*a* is a section on the line X—X of FIG. 3.
Figure 4:
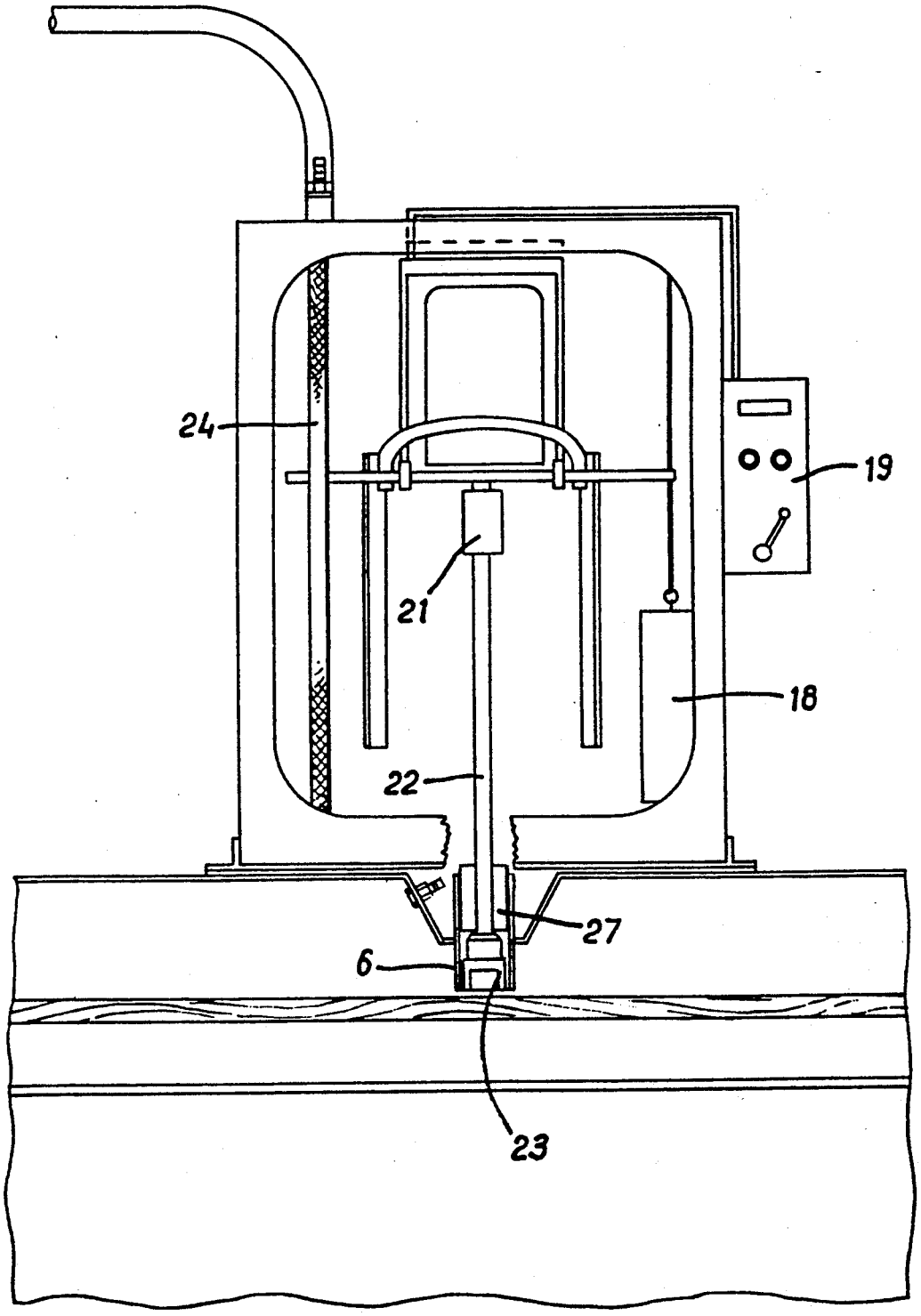
FIGS. 4 and 4*a* respectively show the cabinet of FIG. 3 mounted on the containment with cutting about to commence and when completed.
Figure 4A:
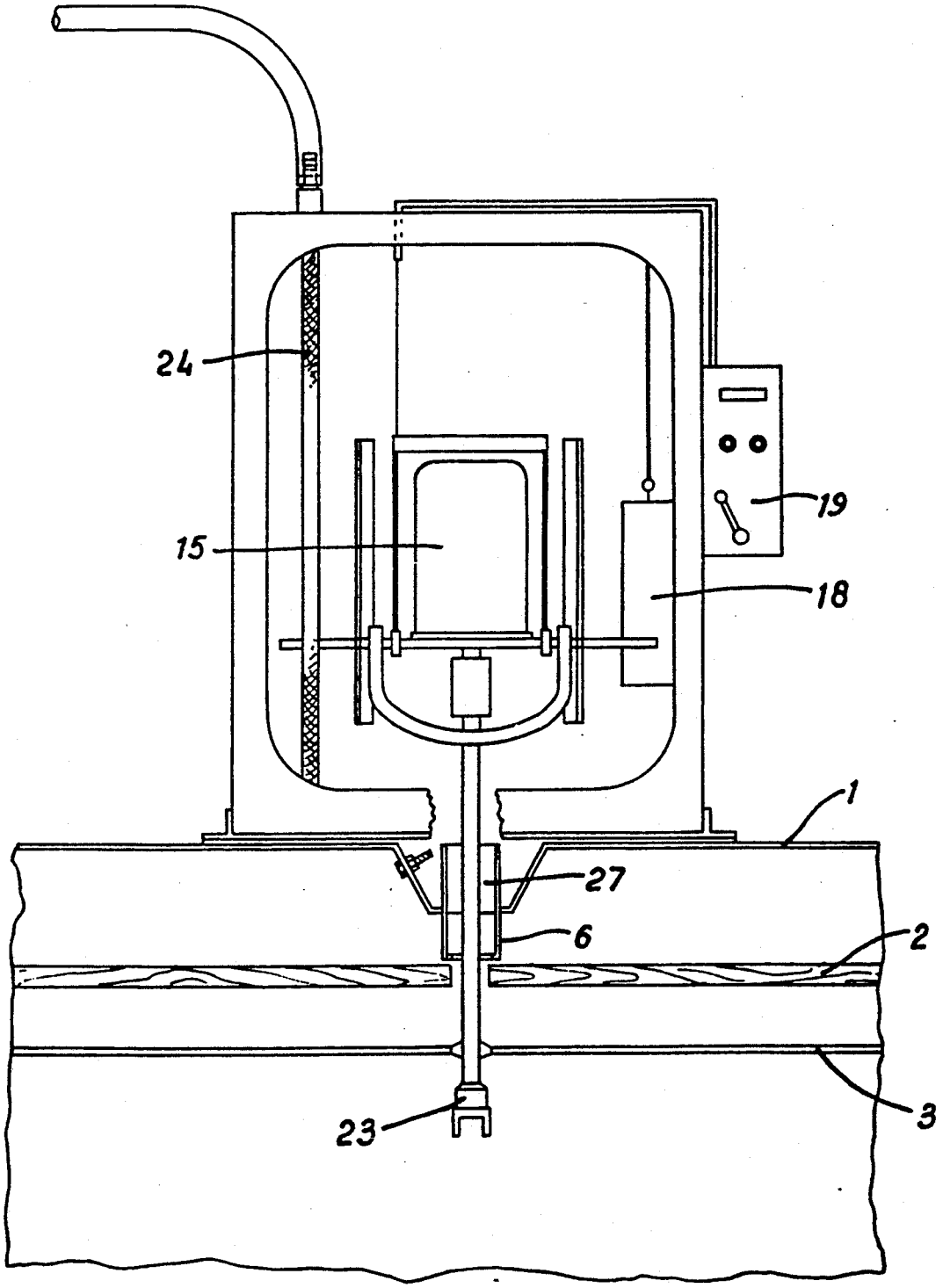

FIGS. 3 and 3*a* show respectively a front elevation and section of a cabinet 14 for mounting on the lid 4 at the port 5. The cabinet 14 support an electric drive motor 15 displaceable vertically within the cabinet 14 by means of a hand lever 16 cooperable with racks 17 fixedly mounted on a wall of the cabinet 14. The vertical displacement of the motor 15 is controlled by a counter-weight 18. Power for the drive motor 15 is supplied through a control box 19 mounted on the exterior of the cabinet 14. An opening 20 in a wall provides controlled access to the interior of the cabinet 14. The motor 15 drives a socket 21 and as shown in FIGS. 4 and 4*a* one end of a hollow stem 22 is releasably engageable in the socket 21. A cutter tool 23 is fixedly secured to the opposite end of the hollow stem 22. A plurality of radial bores (not shown) extend through the cutter tool 23 and the wall of the stem 22 to communicate with the interior of the stem 22.

Referring again to FIG. 3*a*, a grout feed pipe 24 extends into the cabinet 14 and has a length to reach the floor of the cabinet 14. The end of the pipe 24 within the cabinet 14 is provided with a releasable coupling 25 capable of cooperating with an associated coupling (not shown) at the upper end of the hollow stem 22 (see FIG. 4). A further pipe 26 within the cabinet 14 cooperates with the vent coupling 10 (see FIG. 2) in the well 8 of the lid 4. The pipe 26 passes through an opening in the floor of the cabinet 14. The opening cooperates with the well 8 in the lid 4 to permit the cutter tool 23 to enter into the tube 6. The stem 22 is supported at the tube 6 by a bearing block 27 which permits axial and rotational movement of the stem 22. The block 27 is clamped in position in the tube 6 by the locking screw 11 (FIG. 2).

In use, the cabinet 14 is positioned on the container 1 and over the entry port 5. With the hollow stem 22 carrying the cutter tool 23 engaged in the coupling socket 21, the drive motor 15 is lowered to cause the tool 23 to break through, in succession, the bursting disc 9 at the bottom of the tube 6, the wall of the crate 2 and the wall of the glove box 3. The downward motion is continued until the socket 21 reaches the tube 6. The socket 21 is then released from the stem 22 by lifting the motor 15 back to its initial position and the coupling 25 at the end of the grout feed pipe 24 is engaged with the coupling at the upper end of the stem 22 at the tube 6. Grout slurry is pumped along the pipe 24 to pass along the hollow stem 22 and emerge through the radial bores at the opposite end of the stem 22 into the interior of the glove box 3. The contents of the glove box 3 are immersed in the grout slurry which progressively fills the complete containment of glove box 3, crate 2 and container 1. Air displaced upon filling by the grout slurry is expelled through the vent pipe 26 coupled to the coupling 10. When the containment is filled the grout feed pipe 24 is released from the end of the stem 22 at the well 8 in the lid 4, and the cover plate 12 is secured in position. The stem 22 remains within the containment and forms a part of the contents thereof which are embedded in the grout when set. The end product comprises a solid block containing waste products including the glove box 3 and its contents.

The containment can include more than one glove box. For example, the containment can comprise an outer container capable of accommodating a plurality of crates and/or glove boxes and having a corresponding plurality of entry ports and a corresponding plurality of cutting means maybe provided.

I claim:

1. A method of containing wastes and comprising, placing the wastes in a container and introducing a grout slurry into the container to fill voids in the container, thereby to embed the wastes into a solidified mass upon setting of the grout slurry, wherein the improvement comprises, closing the container with the wastes therein, piercing the container with hollow cutting means, introducing the grout slurry into the container through the cutting means, and retaining the cutting means in the container.

2. A method as claimed in claim 1, wherein the wastes are disposed within a crate, the crate is placed within the container, and the cutting means pierces the container and the crate so as to introduce the grout slurry into the crate.

3. A method as claimed in claim 2, wherein the wastes are disposed within a plurality of said crates, and a corresponding plurality of said cutting means pierce the container at a corresponding plurality of locations and pierce the respective crate.

4. A method as claimed in claim 1, wherein the wastes comprise a glove box and the contents thereof, and the cutting means pierces the glove box in the container so as to introduce the grout slurry into the glove box.

5. A method as claimed in claim 4, wherein the wastes are disposed within a plurality of said gloveboxes, and a corresponding plurality of said cutting means pierce the container at a corresponding plurality of locations and pierce the respective said glove box so as to introduce the grout slurry therein.

6. A method as claimed in claim 1, including venting the container whilst introducing the grout slurry.

7. A method as claimed in claim 6, wherein at least some of said grout slurry is transversely dispersed by the cutting means.

8. Apparatus for containing wastes and comprising a closable container for enclosing the wastes, hollow cutting means for piercing the container and for introducing a grout slurry therethrough into the container, the cutting means being detachable so as to be retained in the container after the grout slurry has been introduced therein.

9. Apparatus as claimed in claim 8, including a crate for housing the waste in the container, the cutting means being adapted to pierce the crate in the container so as to introduce the grout slurry into the crate.

10. Apparatus as claimed in claim 8, wherein the wastes comprise a glove box and the contents thereof, and the cutting means is adapted to pierce the glove box in the container so as to introduce the grout slurry into the glove box.

11. Apparatus as claimed in claim 8, wherein the container has a wall with a port means therein for locating the cutting means.

12. Apparatus as claimed in claim 11, wherein the port means includes vent means for venting air displaced from the container by the grout slurry.

13. Apparatus as claimed in claim 11, wherein the cutting means comprises a cutting tool, a stem portion arranged to drive the cutting tool, and a bearing means in which the stem portion is locatable, the bearing means being arranged to locate in the port means.

14. Apparatus as claimed in claim 13, including means for rotating the stem portion and for axially displacing the stem portion and thereby the cutting tool, and releasable means for connecting the stem portion to the rotating and axially displacing means.

15. Apparatus as claimed in claim 14, including grout filling means releasably connectable to the stem portion.

16. Apparatus as claimed in claim 14, wherein a plurality of said ports are provided for locating a corresponding plurality of respective said cutting means.

17. Apparatus as claimed in claim 14, wherein the cutting means includes means for discharging said grout slurry transversely in the container.

18. Apparatus for containing wastes and comprising, a) a container for containing watstes;

b) a lid for the container;

c) at least one port in the lid, the port comprising a converging well, a tube extending through the well, a bursting disc at that end of the tube inside the container, a vent in the well from the container, a locking screw extending through the wall of the tube at the other end thereof, and a disconnectable cover plate for the port;

d) a cutting device comprising a hollow rotary cutting tool, a hollow stem joined at one end to the cutting tool, and a cylindrical bearing block about the stem arranged to locate in the tube and be locked therein by the locking screw;

e) a connector arranged to releasably connect with the other end of the stem;

f) a drive motor having a drive shaft connectable to the connector;

g) rack and pinion means for displacing the motor and thereby the stem and cutting tool axially;

h) a flexible feed pipe for grout slurry releasably connectable to the other end of the stem;

i) and a flexible vent pipe releaseable connectable to the vent, whereby in operation with the bearing block located in the tube, rotation and axial displacement of the stem by the motor causes the cutting tool to pierce the bursting disc and enter the container, and subsequent connection of the grout slurry feed pipe to the stem without withdrawal of the cutting tool from the container causes a grout slurry to be discharged into the container and thereby embed the wastes when set, the cutting tool being embedded in the container, and the cover plate then being fitted to seal said port.

19. Apparatus as claimed in claim 18, wherein the wastes comprises a glove box and the contents thereof, and wherein a crate in which the glove box is located is inside the container, the cutting device being arranged to pierce the container, the crate, and the glove box.

* * * * *